US009228354B2

(12) United States Patent
McClure

(10) Patent No.: US 9,228,354 B2
(45) Date of Patent: Jan. 5, 2016

(54) METAL ROOF PENETRATION THERMAL BREAK

(71) Applicant: BlueScope Buildings North America, Inc., Kansas City, MO (US)

(72) Inventor: Richard R. McClure, Basehor, KS (US)

(73) Assignee: BlueScope Buildings North America, Inc., Kansas City, MO (US)

( * ) Notice: Subject to any disclaimer, the term of this patent is extended or adjusted under 35 U.S.C. 154(b) by 0 days.

(21) Appl. No.: 14/551,729

(22) Filed: Nov. 24, 2014

(65) Prior Publication Data

US 2015/0143772 A1 May 28, 2015

Related U.S. Application Data

(60) Provisional application No. 61/909,724, filed on Nov. 27, 2013.

(51) Int. Cl.

| | |
|---|---|
| ***E04D 13/16*** | (2006.01) |
| ***E04D 13/03*** | (2006.01) |
| ***E04B 7/18*** | (2006.01) |

(52) U.S. Cl.
CPC . *E04D 13/16* (2013.01); *E04B 7/18* (2013.01); *E04D 13/0315* (2013.01)

(58) Field of Classification Search
CPC ..... E04D 13/0315; E04D 13/16; E04B 7/18
See application file for complete search history.

(56) References Cited

U.S. PATENT DOCUMENTS

| | | | | |
|---|---|---|---|---|
| 3,969,858 | A | 7/1976 | Naidus | |
| 4,073,097 | A * | 2/1978 | Jentoft et al. | 52/22 |
| 4,439,962 | A | 4/1984 | Jentoft et al. | |
| 4,559,753 | A * | 12/1985 | Brueske | 52/748.1 |
| 4,594,821 | A | 6/1986 | Bechtold et al. | |
| 5,896,711 | A * | 4/1999 | McClure | 52/200 |
| 5,913,785 | A * | 6/1999 | Moller et al. | 52/200 |
| 6,079,167 | A * | 6/2000 | Voegele, Jr. | 52/200 |
| 8,438,800 | B2 * | 5/2013 | McLain et al. | 52/200 |
| 8,438,801 | B2 * | 5/2013 | McLain et al. | 52/200 |
| 8,561,364 | B2 * | 10/2013 | Pendley et al. | 52/200 |
| 2012/0233941 | A1 * | 9/2012 | McLain et al. | 52/200 |
| 2012/0233942 | A1 * | 9/2012 | McLain et al. | 52/200 |
| 2013/0239500 | A1 * | 9/2013 | Pendley et al. | 52/302.1 |
| 2013/0239513 | A1 * | 9/2013 | Pendley et al. | 52/742.12 |
| 2014/0260068 | A1 * | 9/2014 | Pendley et al. | 52/710 |
| 2015/0013241 | A1 * | 1/2015 | Pendley et al. | 52/90.1 |
| 2015/0013247 | A1 * | 1/2015 | Pendley et al. | 52/200 |
| 2015/0013248 | A1 * | 1/2015 | Pendley et al. | 52/200 |

OTHER PUBLICATIONS

PCT Patent Application No. PCT/US2014/067107 International Search Report and Written Opinion dated Mar. 6, 2015, 14 pages.

* cited by examiner

*Primary Examiner* — Andrew J Triggs
(74) *Attorney, Agent, or Firm* — Lathrop & Gage LLP

(57) ABSTRACT

Disclosed is a system for improving the condensation resistance of metal roof penetrations. When environmental conditions are right, the curbs associated with metal roof penetrations can experience condensation on metal parts for which there is no thermal break. The disclosed system provides a mechanism to implement a thermal break to prevent the formation of condensation.

8 Claims, 3 Drawing Sheets

METAL ROOF PENETRATION THERMAL BREAK

RELATED APPLICATION

This application claims the benefit of priority to U.S. Provisional Application No. 61/909,724 filed on Nov. 27, 2013. The disclosure of which is incorporated herein by reference.

TECHNICAL FIELD

The present disclosure relates to improving the condensation resistance of a metal roof penetration in accordance with principles of the present disclosure.

BACKGROUND

With the current design of metal roof curbs the sidewall configuration of the curb tends to have a thermal short circuit into the inside area of the building. This is caused by the continuance of the metal through the sidewall section from the outside to the inside. This can cause the inside surface of the metal curb to remain at a temperature below the dew point temperature that can lead to condensation forming on the inside surface, causing what appears to water leaks within the building. The current method of addressing this problem is to trim and retain the surrounding roof insulation which does not present a thermal-break in the curb wall. This method is labor intensive and the foam retaining rod used to secure the surrounding roof insulation can become dislodged. Moreover, the use of the retaining rod, in this fashion, often times does not result in a pleasing visual experience for the finished installation.

For the foregoing reasons, there is a need to eliminate the loss of heat from the interior surfaces so the surfaces remain at a temperature above the dew point so that condensation does not occur on any surface.

For the foregoing reasons, there is a need for an inexpensive alternative to trimming off of the excess roof insulation.

For the foregoing reasons, there is a need for an alternative to the trimming off of the roof insulation that provides a more aesthetically appealing appearance upon completion of the installation of the insulation.

SUMMARY

Curbs are constructed on metal roofs around skylights and mechanical equipment such as heating or air condition units, to divert rain precipitation around the unit. The curbs are usually constructed as a rectangle whose side walls are parallel to corresponding sides of the roof.

In an exemplary embodiment a system is disclosed to provide a thermal break to eliminate a thermal short circuit in the system to maintain a minimum surface temperature above the dew point for the conditions present, to provide a system to retain the surrounding roof insulation that is cost effective and provides for the above mentioned thermal break; to provide a cleaner, more aesthetically pleasing appearance to the surrounding roof insulation, to utilize an insulating retaining rod configured to secure the surrounding roof insulation within the configuration of components that eliminates the possible inadvertent release of the retaining rod and the insulation as presently experienced with existing systems. In addition, the disclosed embodiment provides an easier to install application of the foam retaining rod over current designs as well as a design that can be used with any metal roof curbs used to support mechanical units including HVAC units, fans, as well as other applications of skylights and roof hatches.

Various objects, features, aspects and advantages of the inventive subject matter will become more apparent from the following detailed description of preferred embodiments, along with the accompanying drawings in which like numerals represent like components. The contents of this summary section are provided only as a simplified introduction to the disclosure, and are not intended to be used to limit the scope of the appended claims.

The contents of this summary section are provided only as a simplified introduction to the disclosure, and are not intended to be used to limit the scope of the appended claims.

DETAILED DESCRIPTION

The following description is of various exemplary embodiments only, and is not intended to limit the scope, applicability or configuration of the present disclosure in any way. Rather, the following description is intended to provide a convenient illustration for implementing various embodiments including the best mode. As will become apparent, various changes may be made in the function and arrangement of the elements described in these embodiments without departing from the scope of the appended claims.

Metal buildings with metal roofs have become popular for commercial, industrial and warehousing uses. These buildings often require roof openings for skylights, fans, air conditioning units and the like. The installation of such equipment requires a roof curb for support.

Traditionally, roof curbs have been designed specifically and custom made to provide a relatively horizontal mounting structure for a particular rooftop appliance given the shape and pitch of a particular roof. Designing and building these traditional roof curbs, often formed from a singular piece of metal to uniquely accommodate a particular roof pitch, has been a laborious and time consuming task for roof curb manufacturers and rooftop appliance installers.

Figure 1:
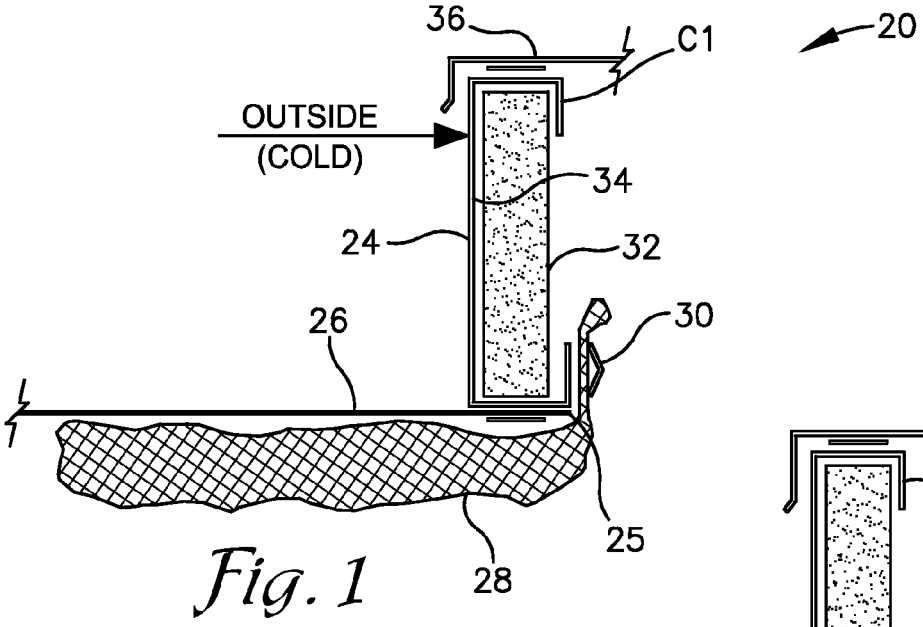
FIG. 1 illustrates a cutaway view of an embodiment of a roof curb sidewall section.

Turning now to FIG. 1 which reveals a curb section 20 with reference to the interior and exterior of the curb and building structure. The roof curb sidewall section 24 is positioned past the cut edge 25 of the roof structure 26. The roof insulation 28 wraps beneath the curb sidewall section 24 and is held in position by a clip element 30 at the curb sidewall section 24. A layer of insulation 32 is also disposed against the interior surface 34 of the roof curb sidewall section 24. A skylight 36 is positioned over the curb section to allow access of daylight and to prevent intrusion of moisture. This particular design, when environmental conditions are aligned will support the formation of condensation on metal surfaces proximate C1. When the condensation forms at this point many occupants of the building will characterize this as a leaking roof and seek roof repairs when in reality with the design identified under FIG. 1 little can be done to prevent the formation of condensation other than to prevent the interior temperature and humidity from reaching the point where condensation forms.

Figure 2:
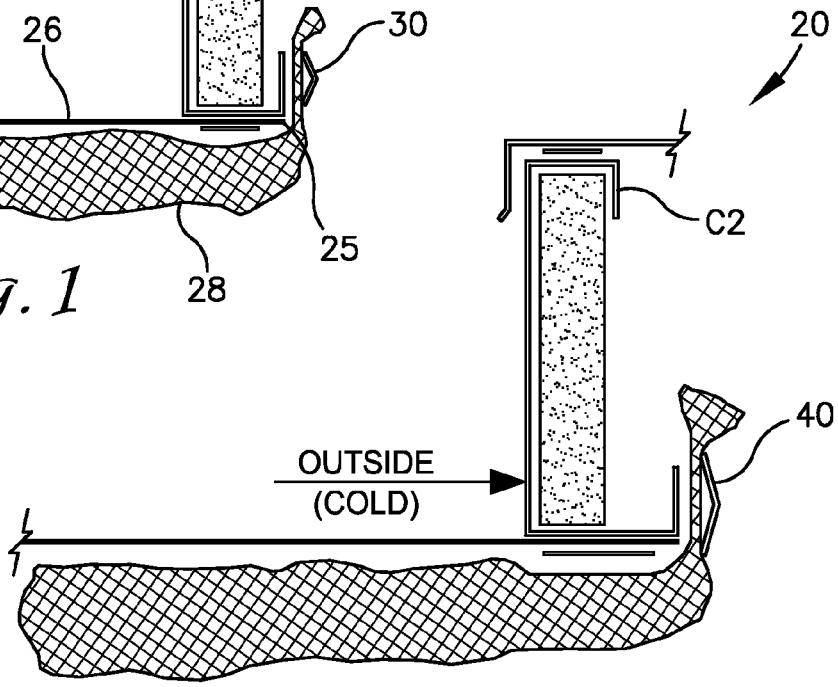
FIG. 2 illustrates a cutaway view of an embodiment of a roof curb sidewall section detailing an insulation termination method.

Turning now to FIG. 2 which reveals an alternative configuration which also suffers from the deficiency that condensation may form at C2. This design is similar in most respects as regards the metal roof curb 20 and skylight 36 detailed in FIG. 1, but instead employs an insulation retainer 40 to hold the roof insulation in position.

Figure 3:
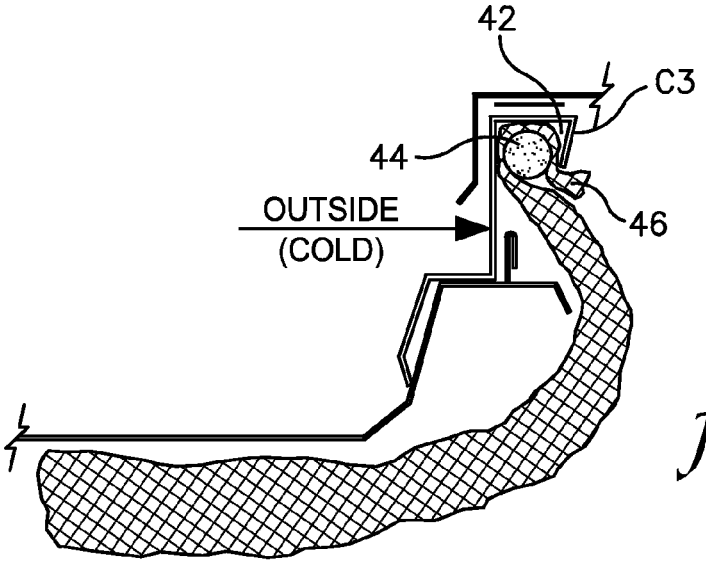
FIG. 3 illustrates a cutaway view of an embodiment of a roof curb sidewall section detailing an alternative insulation termination method.

FIG. 3 illustrates a current method of trimming and retaining the surrounding roof insulation 28 which is quite labor intensive. In addition, this particular methodology results in an appearance that is less than desirable as roof insulation can fall out of the slot 42 that retains a flexible insulating rod 44 and the end of the insulation 46. This configuration is also deficient in that it does not provide a thermal break and condensation can form at C3.

Figure 4:
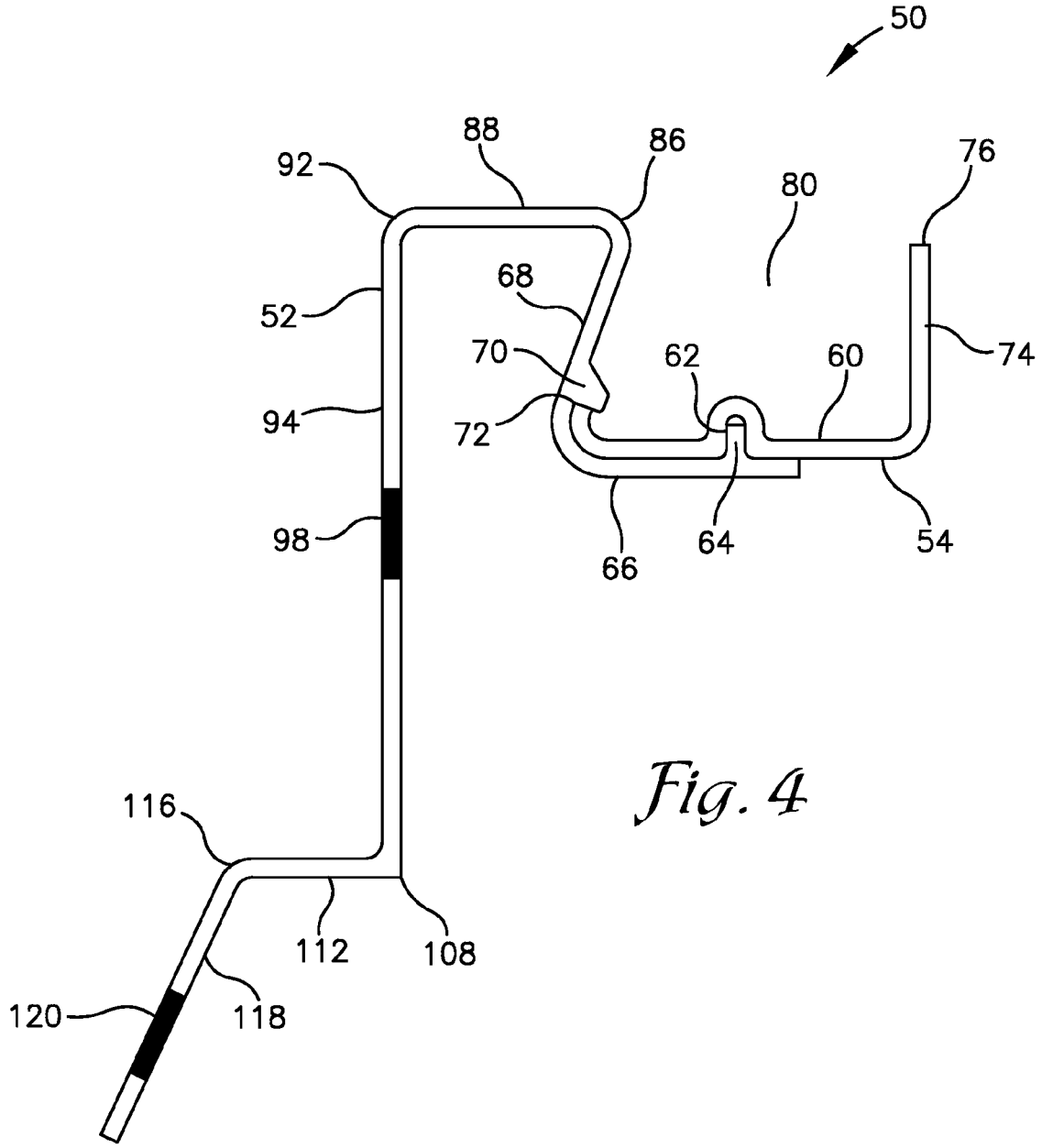
FIG. 4 illustrates an embodiment of the assembly of the thermal break and the side rail.

Turning now to FIG. 4 which details an exemplary embodiment of an insulating assembly 50 comprising a side rail 52 inter-engaged with a thermal-break 54 segment for preventing the formation of condensation on roof curb installations. The thermal break element 54 is preferably comprised of an engineered plastic such as polyvinyl chloride (PVC), that is interlocked with a side rail 52 preferably comprised of an extruded aluminum. The thermal break element 54, just as the name suggests, is an insulator and serves to limit the transfer of heat away from the interior to the exterior of the structure.

The thermal-break 54 horizontal segment 60 includes a slot 62 that engages and interlocks with an upwardly extending flange 64 on the first segment 66 of the side rail 52. In addition, the second segment 68 of the side rail 52 includes a hard stop 70 that abuts the first terminating edge 72 of the thermal-break 54. The vertical wall 74 of the thermal break 54 terminate at an upper edge 76 and in conjunction with the oppositely disposed upwardly extending second segment 68 of the side rail 52 forms a pocket 80 for positioning of a longitudinally extending insulating rod 84 (seen in FIG. 5). The insulating rod 84 serves to limit the transfer of heat between the interior space of the structure and the ambient environment and in conjunction with the thermal-break 54 can substantially reduce the potential for the formation of condensation. The second segment 68 of the side rail 52 terminates at a bend 86 of greater than 90 degrees and traverses into the third segment 88 of the side rail. When installed, the third segment 88 will be penetrated by self-tapping screws that secure the insulating assembly 50 to the skylight or other feature installed on the curb 90. The third segment 88 is bent downwardly at a corner 92 to form a fourth segment 94. The fourth segment 94 at approximately mid-span includes a plurality of through holes 98. The through holes 98 are used for passing mounting hardware 100 through the fourth segment 94 and to anchor the faced insulation 104 in place as best seen in FIG. 5

The fourth segment 94 extends downwardly to a termination point 108 and turns outwardly at approximately a 90 degree angle to form a fifth segment 112. The fifth segment 112, like all of the prior segments, may be of any desired length to accommodate the desired configuration of the structure being secured to the curb. The fifth segment 112 extends to a termination point 116. A sixth segment 118 extends downwardly from the termination point 116 at a preferred angle of approximately 75 degrees; however, other angles of departure are also appropriate depending upon the configuration of the structure secured to the roof. The sixth segment 118 further includes a plurality of longitudinally displaced through holes 120. The through holes allow passage of securement hardware 124 to attach the entire side rail 52 and the entire insulating assembly 50 to the ribs 130 of, for example, standing seam metal roof panels 132.

Figure 5:
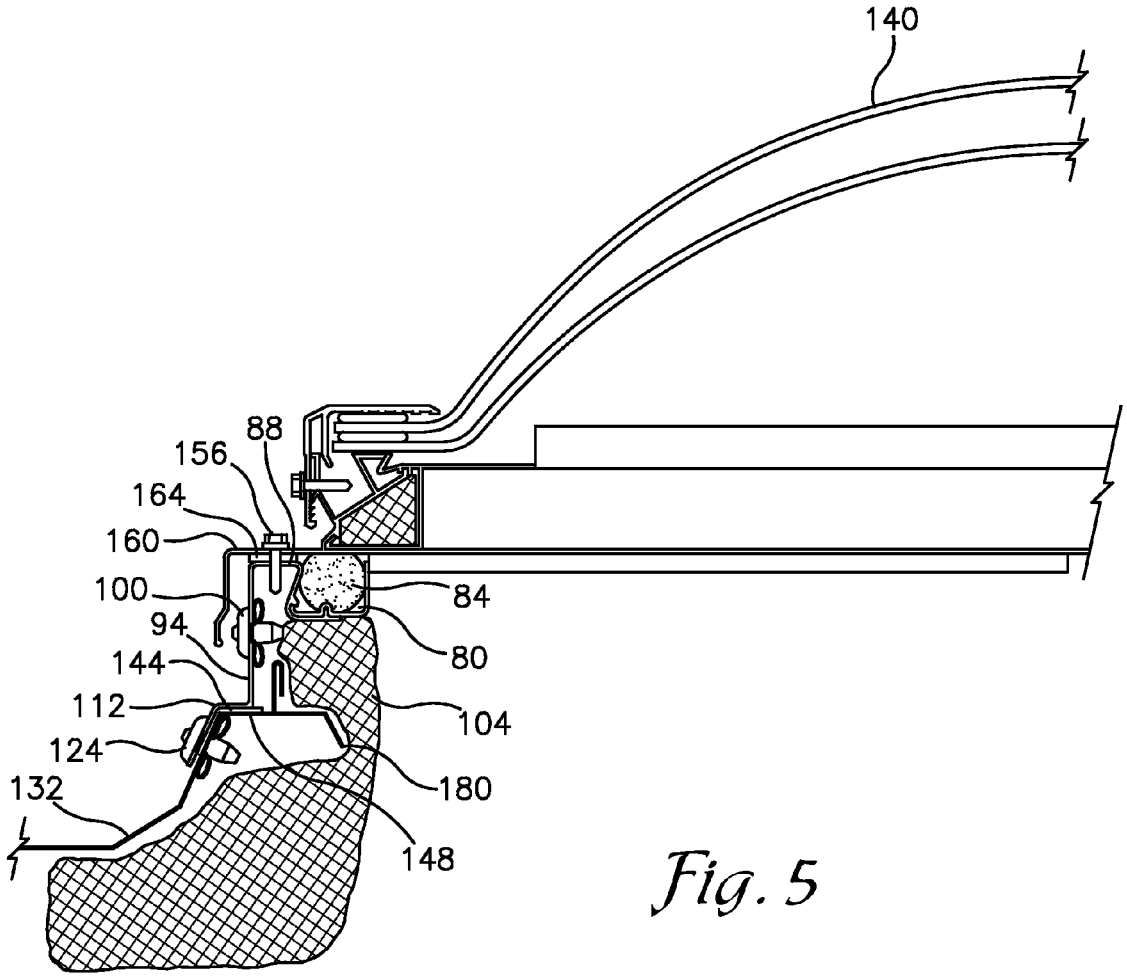
FIG. 5 illustrates a cutaway view of an embodiment of the insulating assembly detailing the disclosed technology.

FIG. 5 illustrates an embodiment of the insulating assembly 50 in position beneath a domed skylight 140. In application of the insulating assembly, first an appropriately sized opening is cut into the roof panels 132 of the structure. For example, in a standing seam roof the roof panel 132 will be cut on the interior side of the seams. Once the opening in the roof structure has been created, installation of the insulating assembly 50 can commence with the passage of securement hardware 124 through the longitudinally displaced through holes 120 in the sixth segment 118 of the insulating assembly 50. This securement hardware 124 serves to not only secure the insulating assembly to the roof panels 132 but also to secure a flexible weather-seal 144 in position beneath the fifth and sixth segments 112, 118 to prevent intrusion of water into the structure. Multiple units of the securement hardware 124 secure the sixth segment 118 along the entire longitudinal length of the sixth segment 118. Passing the hardware through the sixth segment 118 and into the rib 130 of the roof panel 132 facilitates a watertight seal and rigidly secures the insulating assembly to the roof structure. The fifth segment 112 preferably rests atop the panel ridge 148 and the weather-seal 144 thereby providing further support for the insulating assembly 50.

Extending upwardly from the fifth segment 112 is the fourth vertical segment 94 through which attachment hardware 100 is passed to anchor the faced insulation 104 in position when installed. The faced insulation 104 must be adequately anchored in position or with the passage of time and minor building movements it will loosen and drop from its position thereby reducing the thermal efficiency of the dome installation. Prior to the installation of the domed skylight 140 an insulating rod 84 is positioned into the pocket 80. The diameter of the insulating rod 84 is slightly greater than the width of the longitudinally extending pocket 80 thereby creating a compression fit for the insulating rod 84. Once the domed skylight 140 is installed, the top of the insulating rod 84 will interfere with the skylight flange 160 and will compress slightly forming an airtight seal that will prevent the intrusion of outside air.

Next, the installer of the domed skylight 140, or other roof feature, passes a threaded fastener 156 through the flange 160 of the dome 140 and into the third segment 88. Positioned beneath the flange 160 of the dome 140 is a weather seal 164 that prevents the intrusion of air, and water, into the interior of the building. The passage of the threaded fasteners 156 will secure the weather seal 164 into position and prevent the intrusion of ambient air and moisture.

As previously noted, during installation of the domed skylight 140, or other roof component, as seen in FIG. 5, an edge of the faced insulation 104 is wrapped upward for engagement with the securement hardware 100 through the fourth segment 94. The insulation 104 is then wrapped tightly around the edge 180 of the roof panel that has been cut for the skylight opening and continues to run beneath the remaining roof panels to enhance the thermal efficiency of the structure.

Having shown and described various embodiments of the present invention, further adaptations of the methods and systems described herein may be accomplished by appropriate modifications by one of ordinary skill in the art without departing from the scope of the present invention. Several of such potential modifications have been mentioned, and others will be apparent to those skilled in the art. For instance, the examples, embodiments, geometries, materials, dimensions, ratios, steps, and the like discussed above are illustrative and are not required. Accordingly, the scope of the present invention should be considered in terms of the following claims and is understood not to be limited to the details of structure and operation shown and described in the specification and drawings.

I claim:

1. An insulating system for resisting the formation of condensation at a roof curb installation, the insulating system comprising:

a longitudinally extending thermal break with a substantially horizontal member with a slot disposed therein and a substantially vertical member, the thermal break fabricated from an insulating material;

a longitudinally extending side rail comprised of six contiguous segments, wherein a first segment includes a flange for engagement with the slot formed in the horizontal segment of the thermal break, a second segment extending upwardly from the first segment, a third segment extending substantially horizontally from the second segment, a fourth segment transitioning downwardly from the third segment, a fifth segment extending substantially horizontally from the fourth segment and a sixth segment extending downwardly from the fifth segment, wherein the horizontal and vertical members of the thermal break and the first and second segments of the side rail form a pocket for receiving a longitudinally extending insulating rod such that when the insulating system is installed at a roof penetration the insulating system is secured to a metal roof panel at the sixth segment and the roof curb installation is secured to the insulating system at the third segment.

2. The insulating system of claim 1, wherein the longitudinally extending thermal break is preferably fabricated from an engineered plastic.

3. The insulating system of claim 2, wherein the longitudinally extending thermal break is preferably fabricated from polyvinyl chloride.

4. The insulating system of claim 1, wherein an upper contact surface on the insulating rod contacts a surface of an installation being applied to the roof curb wherein the longitudinally extending side rail is preferably fabricated from an extruded aluminum.

5. The insulating system of claim 1, wherein the second segment further comprises a hard stop for abutting a first edge of the thermal break.

6. The insulating system of claim 1, wherein the fourth segment includes a plurality of longitudinally spaced apart through holes.

7. The insulating system of claim 1, wherein the sixth segment includes a plurality of longitudinally spaced apart through holes.

8. The insulating system of claim 1, wherein the installation atop the roof curb is selected from the group consisting of air conditioning units, fans, skylights and roof hatches.

* * * * *